US010273833B2

(12) United States Patent
McCloy

(10) Patent No.: US 10,273,833 B2
(45) Date of Patent: Apr. 30, 2019

(54) ROTOR ASSEMBLY WITH INNER DIAMETER DIVIDER PATTERN

(71) Applicant: BorgWarner Inc., Auburn Hills, MI (US)

(72) Inventor: Chad McCloy, Cortland, NY (US)

(73) Assignee: BorgWarner Inc., Auburn Hills, MI (US)

( * ) Notice: Subject to any disclaimer, the term of this patent is extended or adjusted under 35 U.S.C. 154(b) by 72 days.

(21) Appl. No.: 15/190,295

(22) Filed: Jun. 23, 2016

(65) Prior Publication Data

US 2017/0002696 A1 Jan. 5, 2017

Related U.S. Application Data

(60) Provisional application No. 62/186,440, filed on Jun. 30, 2015.

(51) Int. Cl.
*F01L 1/344* (2006.01)
*F01L 1/047* (2006.01)

(52) U.S. Cl.
CPC ..... *F01L 1/3442* (2013.01); *F01L 1/047* (2013.01); *F01L 2001/3445* (2013.01); *F01L 2001/34423* (2013.01); *F01L 2250/02* (2013.01); *F01L 2250/04* (2013.01)

(58) Field of Classification Search
CPC ..... F01L 2001/34423; F01L 2001/3445
USPC ..... 123/90.17
See application file for complete search history.

(56) References Cited

U.S. PATENT DOCUMENTS

| | | | | |
|---|---|---|---|---|
| 6,386,166 | B1 | 5/2002 | Scott et al. | |
| 6,386,167 | B1 | 5/2002 | Urckfitz et al. | |
| 6,405,696 | B1 | 6/2002 | Borraccia et al. | |
| 8,857,390 | B2 * | 10/2014 | Malen | B22F 5/008 123/90.15 |
| 2001/0006049 | A1 * | 7/2001 | Buehrle, II | F01L 9/02 123/90.12 |
| 2012/0031359 | A1 | 2/2012 | Cuatt et al. | |
| 2014/0026835 | A1 | 1/2014 | Boese et al. | |
| 2016/0290180 | A1 * | 10/2016 | Asahi | F01L 1/3442 |

FOREIGN PATENT DOCUMENTS

| | | | | |
|---|---|---|---|---|
| JP | WO 2015079961 | A1 * | 6/2015 | F01L 1/3442 |

* cited by examiner

*Primary Examiner* — Jorge Leon, Jr.
(74) *Attorney, Agent, or Firm* — Brown & Michaels, PC

(57) ABSTRACT

A phaser with a rotor assembly having a pattern on an inner diameter that acts as a sealing land or divider between the advance supply port and the retard supply port. This pattern allows the advance supply ports and the retard supply ports to be on the same plane, allowing the overall axial length of the rotor to be shorter. The pattern is preferably formed onto the inner diameter of the rotor through net forming.

9 Claims, 11 Drawing Sheets

ROTOR ASSEMBLY WITH INNER DIAMETER DIVIDER PATTERN

BACKGROUND OF THE INVENTION

Field of the Invention

The invention pertains to the field of variable cam timing. More particularly, the invention pertains to a phaser with a rotor assembly having an inner diameter with a divider pattern.

SUMMARY OF THE INVENTION

A phaser with a rotor assembly having a pattern on an inner diameter that acts as a sealing land or divider between the advance supply port and the retard supply port. This pattern allows the advance supply ports and the retard supply ports to be on the same plane, allowing the overall axial length of the rotor to be shorter. The pattern is preferably formed onto the inner diameter of the rotor through net forming.

DETAILED DESCRIPTION OF THE INVENTION

Figure 1:
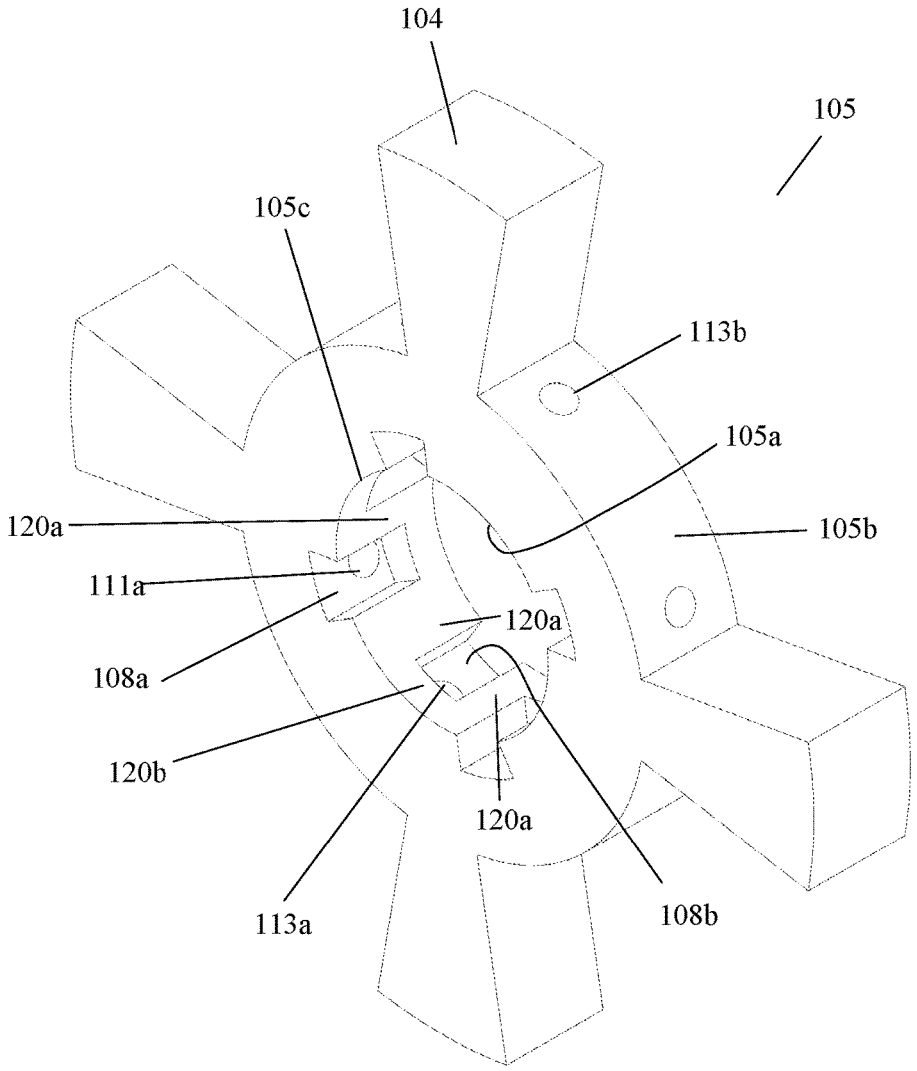
FIG. 1 shows a perspective view of a rotor assembly with a net formed pattern on an inner diameter.
Figure 2:
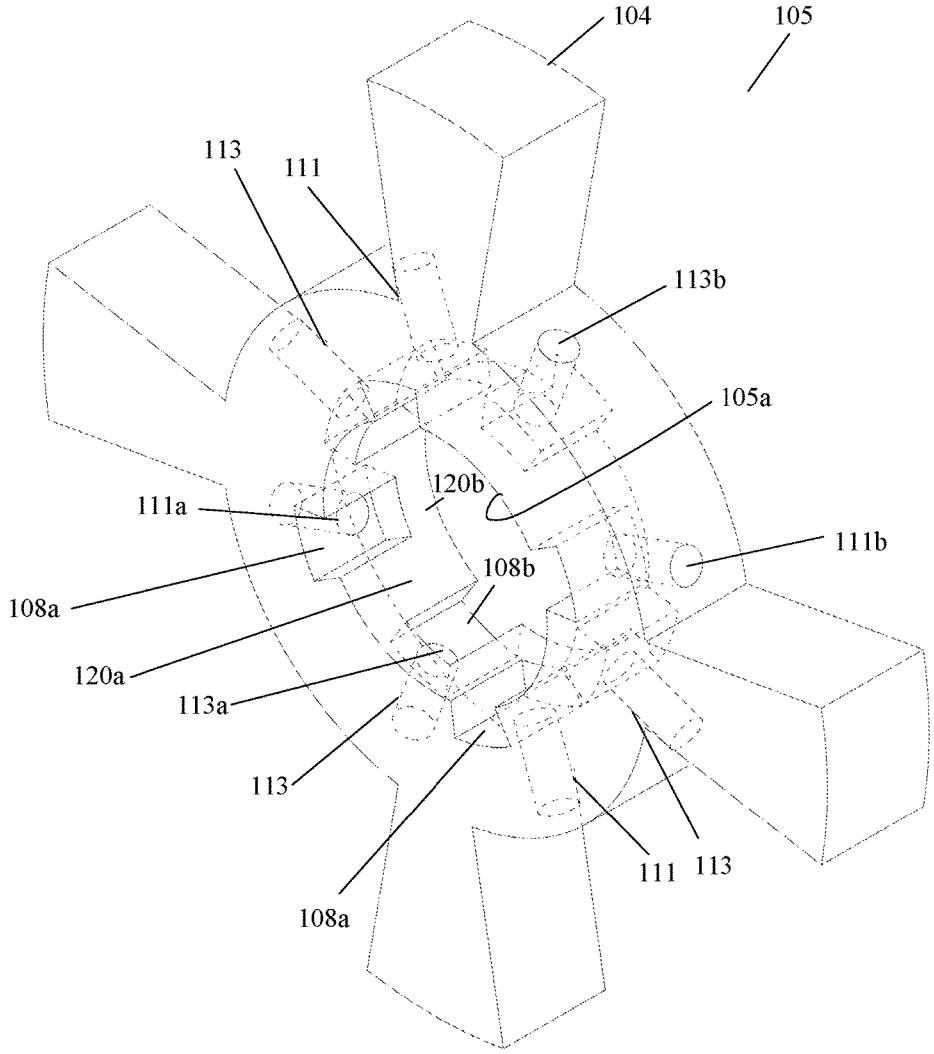
FIG. 2 shows a perspective view of the rotor assembly and associated passages.
Figure 3:
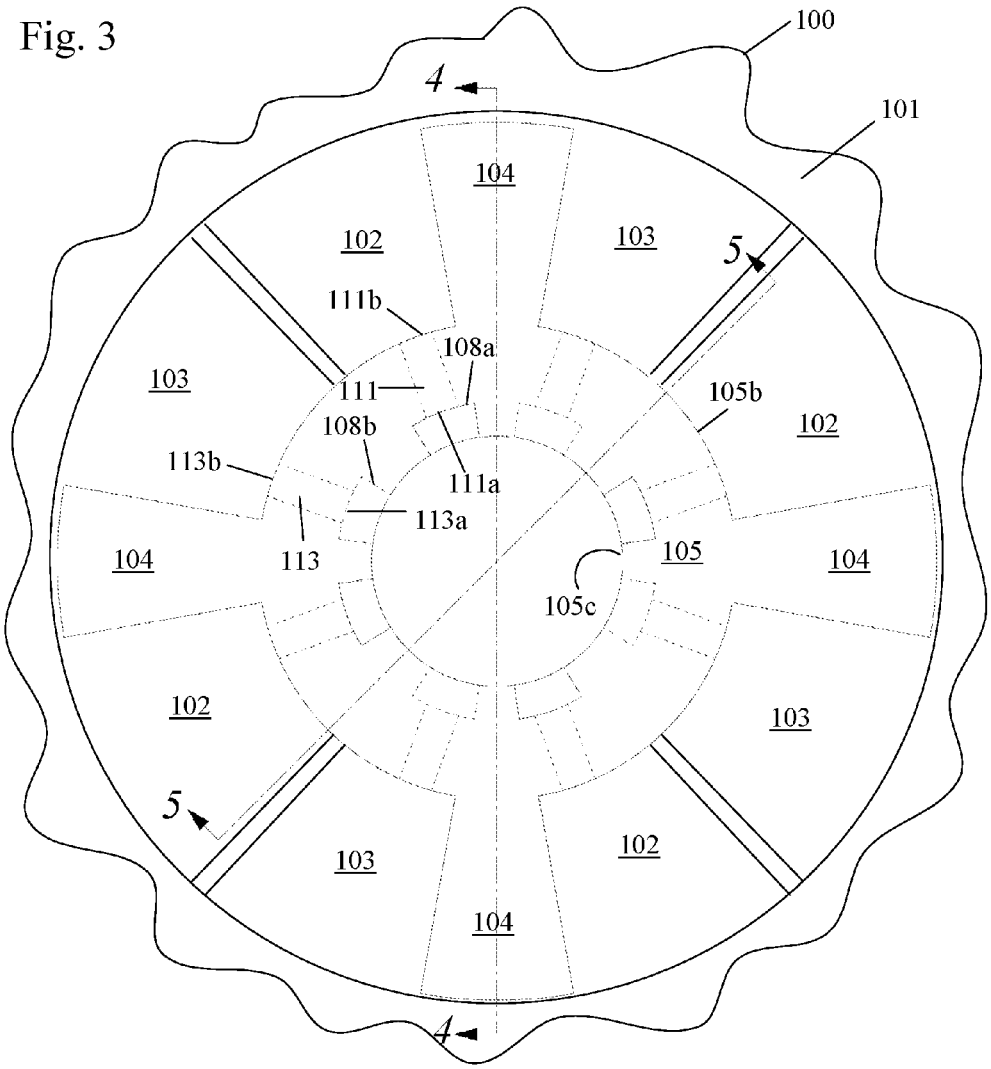
FIG. 3 shows a front view of the rotor assembly with a net formed pattern on an inner diameter.
Figure 4:
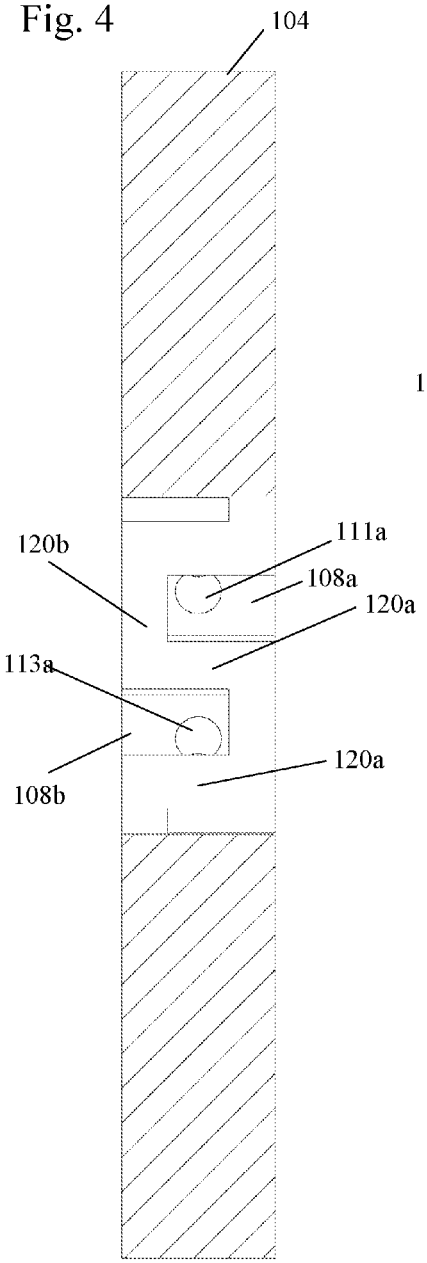
FIG. 4 shows a section view of the rotor assembly of FIG. 3 along line 4-4.
Figure 5:
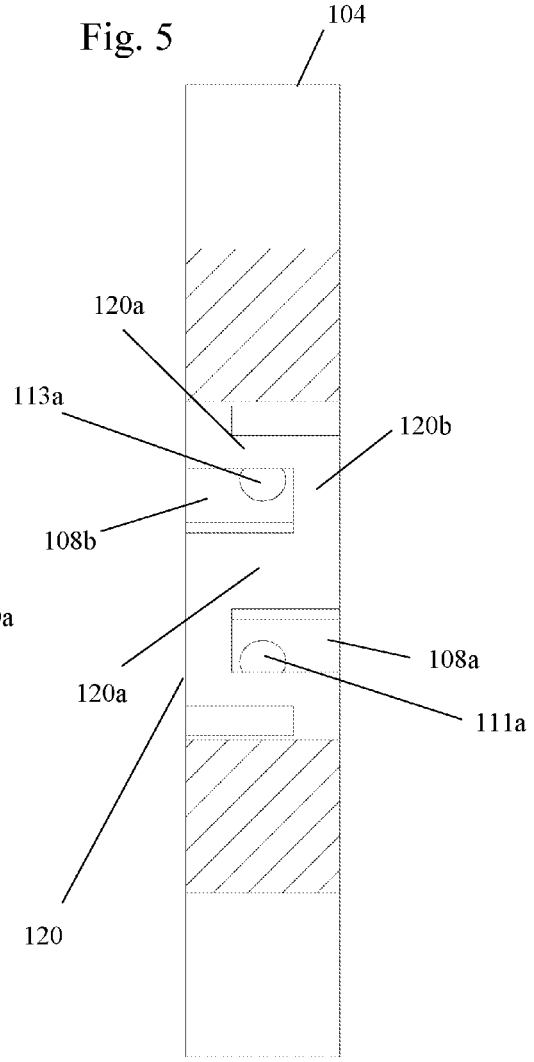
FIG. 5 shows a section view of the rotor assembly of FIG. 3 along line 5-5.

Internal combustion engines have employed various mechanisms to vary the relative timing between the camshaft and the crankshaft for improved engine performance or reduced emissions. The majority of these variable camshaft timing (VCT) mechanisms use one or more "vane phasers" on the engine camshaft (or camshafts, in a multiple-camshaft engine).

Referring to FIGS. 1-5, a housing assembly 100 of the phaser has an outer circumference 101 for accepting drive force, an inner end plate (not shown) and an outer end plate (not shown). The housing's outer circumference 101 forms the sprocket, pulley or gear accepting drive force through a chain, belt, or gears, usually from the crankshaft, or possible from another camshaft in a multiple-cam engine.

A rotor assembly 105 is connected to the camshaft 126 and is coaxially located within the housing assembly 100.

The rotor assembly 105 has an outer diameter 105*b* with vanes 104 extending therefrom and a bore 105*c* with an inner diameter 105*a*. The bore 105*c* receives a camshaft 126. The at least one vane 104 of the rotor assembly 105 separates a chamber formed between the housing assembly 100 and the rotor assembly 105 into an advance chamber 102 and a retard chamber 103. The vane 104 is capable of rotation to shift the relative angular position of the housing assembly 100 and the rotor assembly 105. The rotor assembly 105 also contains fluid passages 111, 113 which connect the advance chamber 102 and the retard chamber 103 to at least a fluid source. The fluid passages 111, 113 extend from the outer diameter 105*b* of the rotor assembly 105 to the inner diameter 105*a* of the bore 105*c* of the rotor assembly 105. Fluid passage 111 has an advance chamber port 111*b* on the outer diameter 105*b* and an advance supply port 111*a* on the inner diameter 105*a* of the bore 105*c* of the rotor assembly 105. Fluid passage 113 has a retard chamber port 113*b* and a retard supply port 113*a* on the inner diameter 105*a* of the bore 105*c* of the rotor assembly 105.

The rotor assembly 105 also has a pattern 120 on the inner diameter 105*a* that acts as a sealing land or divider between the advance supply port 111*a* and a retard supply port 113*a*, forming a pocket 108*a*, 108*b* containing either the advance supply port 111*a* or the retard supply port 113*a*. The pocket 108*a*, 108*b* of the pattern 120 is preferably formed by lands on three sides, with two side lands 120*a* and a land 120*b* along the outer periphery of the inner diameter 105*a* of the rotor assembly 105. The land 120*b* along the outer periphery of the inner diameter 105*a* of the rotor assembly 105 is preferably curved. The pattern 120 is preferably net formed onto the inner diameter 105*a* of the rotor 105 assembly. The pattern 120 continues around the entire inner circumference of the rotor assembly 105.

FIGS. 9-12 shows an end 126*a* of the camshaft 126 in which the rotor assembly 105 is attached and is coaxially located within a housing assembly 101. The end 126*a* of the camshaft 126 has a plate 134 in which the rotor assembly 105 seats against. The end 126*a* of the camshaft 126 also has a bore 126*b* for receiving a bolt 140 which couples the end 126*a* of the camshaft 126 to the rotor assembly 105. The camshaft 126 has an advance passage 129 with an advance inlet port 129*a* and an advance outlet port 129*b* and a retard passage 127 with a retard inlet port 127*a* and a retard outlet port 127*b*.

When the rotor 105 is assembled onto the camshaft 126, the advance outlet port 129*b* is in fluid communication with the advance supply port 111*a* of the rotor assembly 105 and the retard outlet port 127*b* is in fluid communication with the retard supply port 113*a* of the rotor assembly 105.

Figure 6:
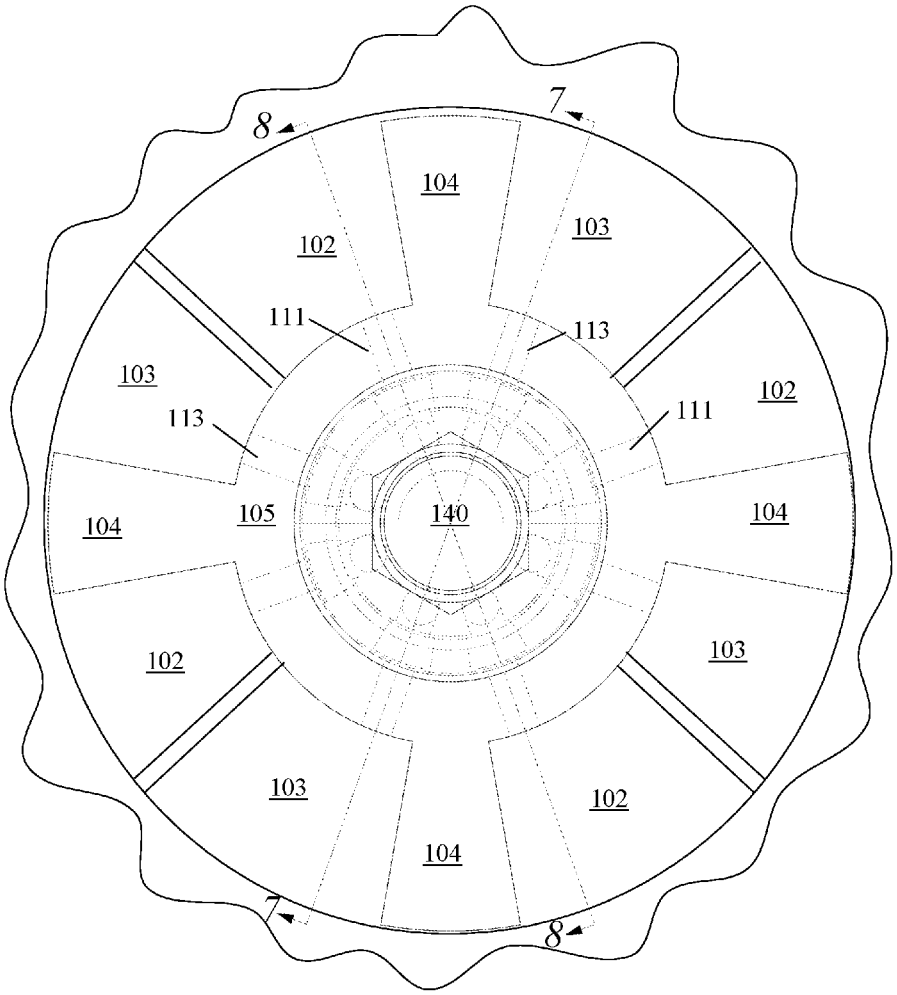
FIG. 6 shows a front view of a cam assembly with a rotor assembly with a net formed pattern on the inner diameter.
Figure 7:
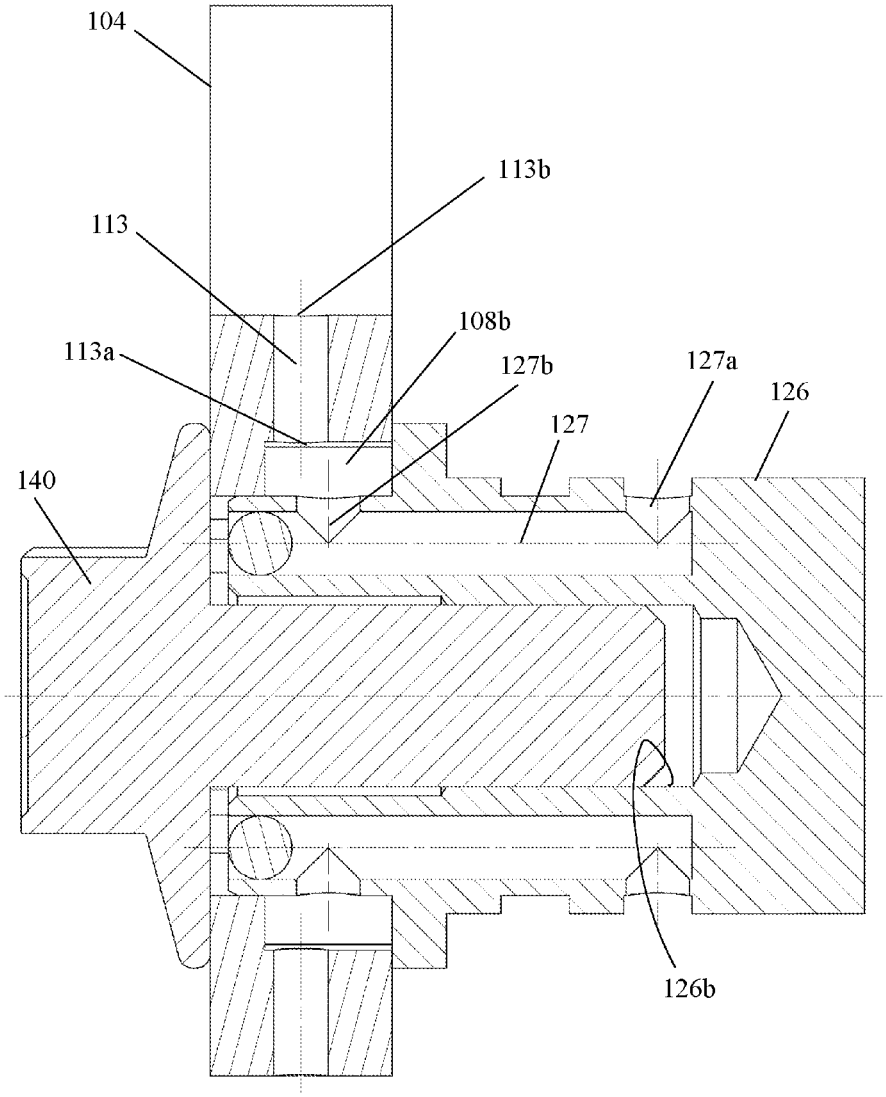
FIG. 7 shows a section view of the cam assembly of FIG. 6 along line 7-7.
Figure 8:
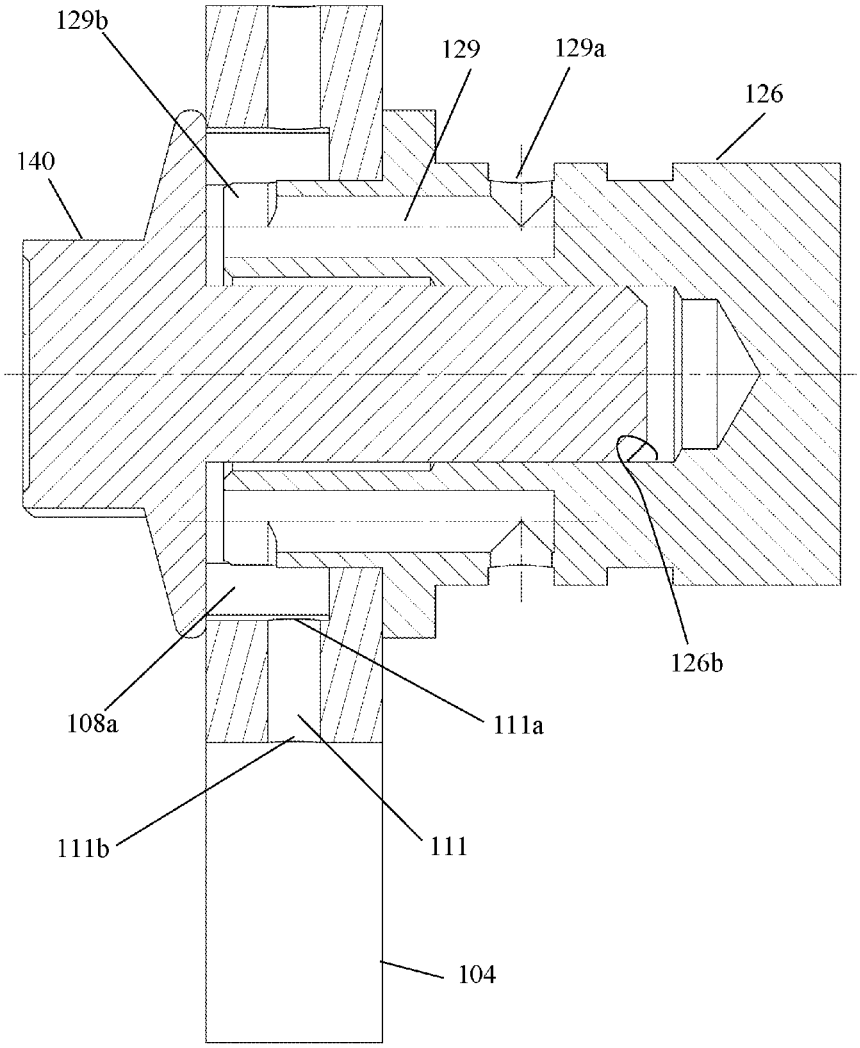
FIG. 8 shows a section view of the cam assembly of FIG. 6 along line 8-8.
Figure 9:
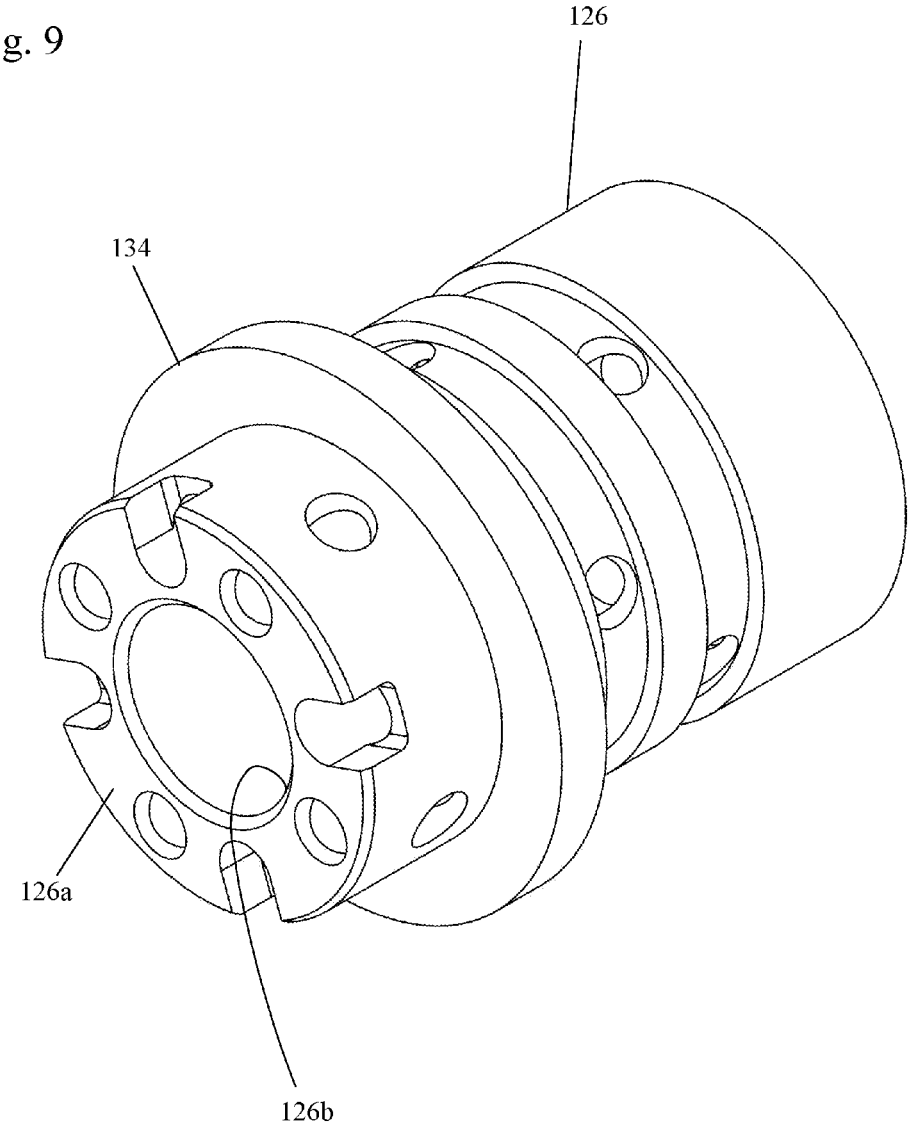
FIG. 9 shows a perspective view of a camshaft end for use in the cam assembly with the rotor assembly with a net formed pattern on the inner diameter.
Figure 10:
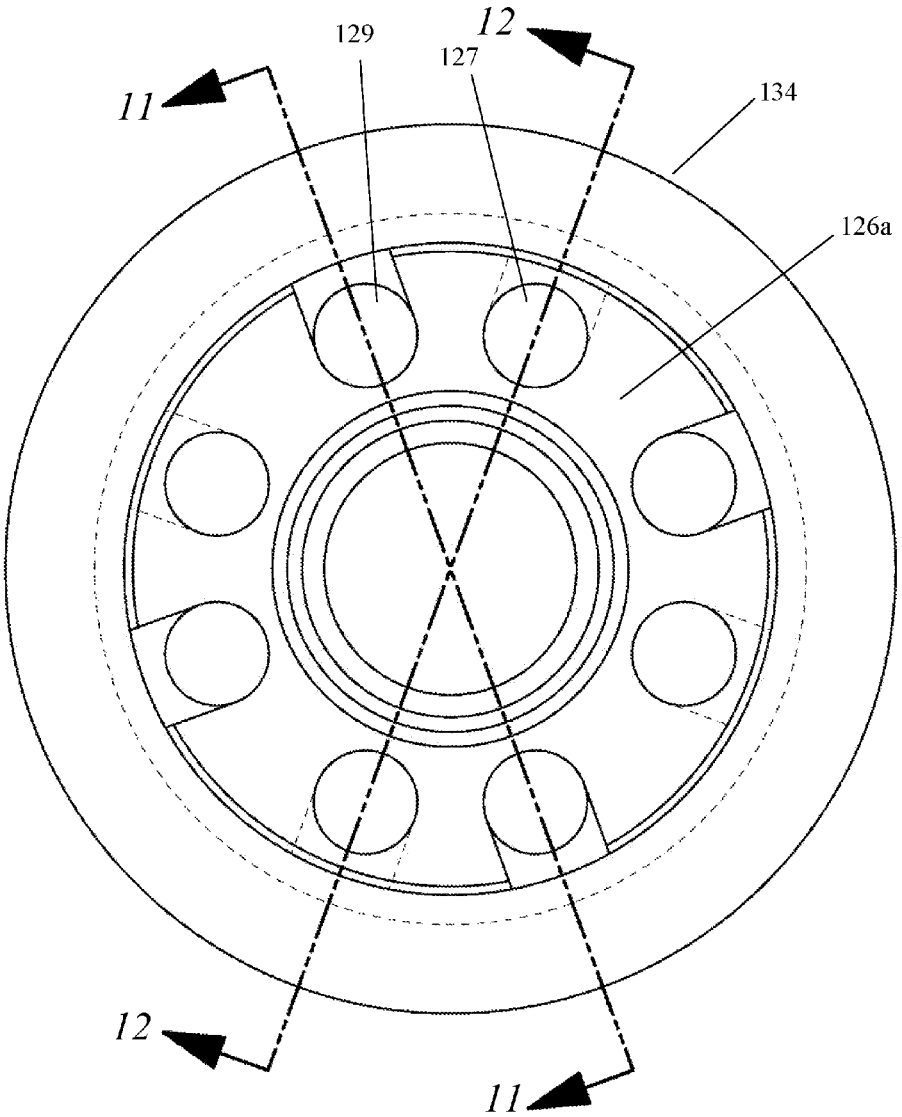
FIG. 10 shows a front view of a camshaft end.
Figure 11:
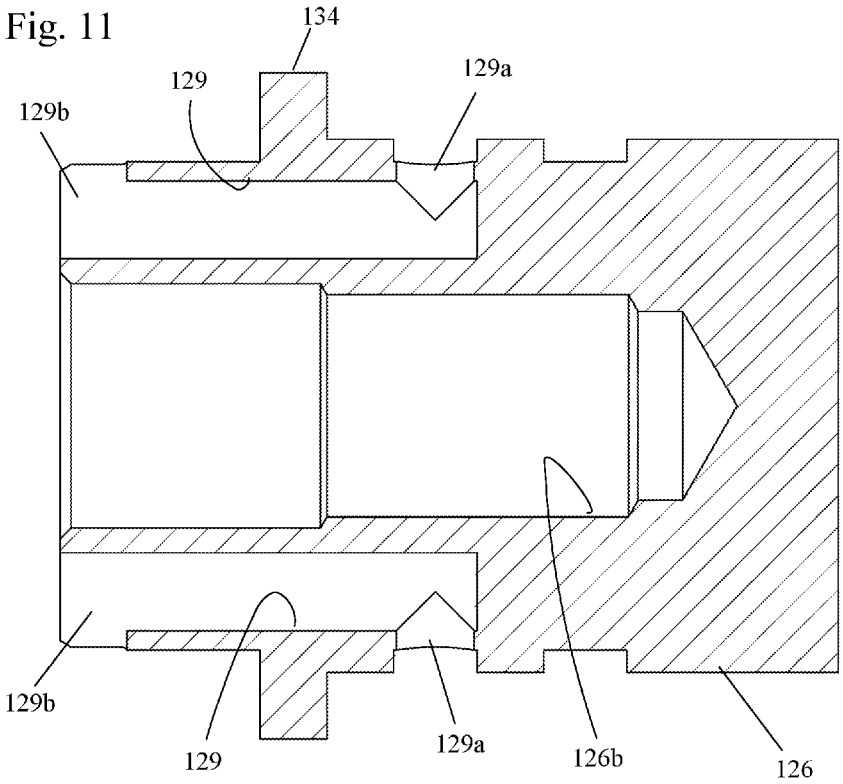
FIG. 11 shows a section view of FIG. 10 along line 11-11.
Figure 12:
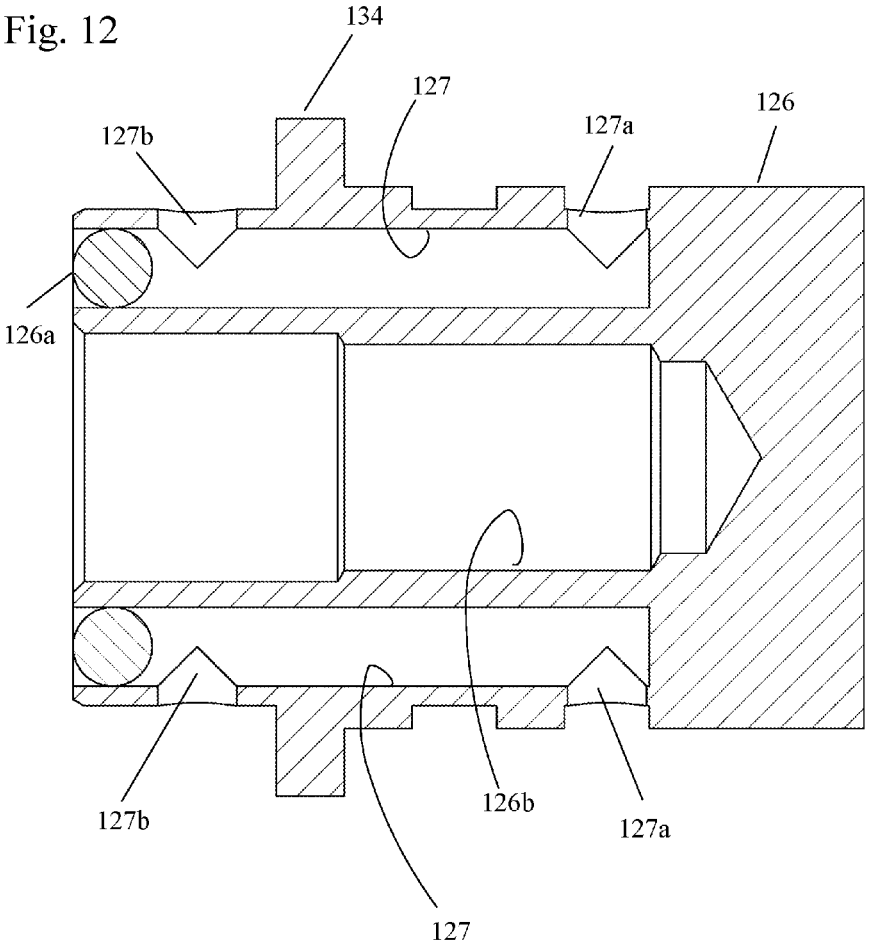
FIG. 12 shows a section view of FIG. 10 along line 12-12.

FIGS. 6-8 shows the rotor assembled onto the camshaft.

Fluid supplied from a source (not shown) may flow to the retard inlet 127*a* of the retard passage 127 and/or an advance inlet 129*a* of the advance passage 129.

Fluid in the retard passage 127 flows out the retard outlet 127*b* to the retard chamber 103 through the pocket 108*b* created by the pattern 120 by entering the retard supply port 113*a*, flowing through the retard passage 113 and exiting into the retard chamber 103 through the retard chamber port 113*b*.

Fluid in the advance passage 129 flows out the advance outlet 129*b* to the advance chamber 102 through the pocket 108*a* created by the pattern 120 by entering the advance supply port 111*a*, flowing through the advance passage 111 and exiting into the advance chamber 102 through the advance chamber port 111*b*.

Fluid may be exhausted from the advance chamber 102 by flowing through the advance chamber port 111*b*, into the advance passage 111, out the advance supply port and into the pocket 108*a*. From pocket 108*a*, fluid flows fluid flows back through the cam passages and is exhausted to engine sump through the oil control valve.

Fluid may be exhausted from the retard chamber 103 by flowing through the retard chamber port 113*b*, into the retard passage 113, out the retard supply port and into pocket 108*b*. From pocket 108*b*, fluid flows back through the cam passages and is exhausted to engine sump through the oil control valve.

The pattern 120 allows the advance and retard supply ports 111*a*, 113*a* of the advance and retard passages 111, 113 of the rotor assembly 105 to be on the same plane and includes a continuous circumferential seal groove, allowing the overall axial length of the rotor assembly 105 to be shorter (thinner rotor assembly).

In an alternate embodiment, the pattern 120 may be present on the camshaft instead of the rotor.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A rotor assembly of a variable cam timing phaser comprising:

an outer diameter with vanes extending therefrom;

a bore having an inner diameter comprising a plurality of passages comprising at least advance passages and retard passages, each of the advance and retard passages extending from the inner diameter of the bore to the outer diameter of the rotor assembly, the advance passages each having an advance supply port on the inner diameter of the bore and an advance chamber port on the outer diameter of the rotor assembly, the retard passages each having a retard supply port on the inner diameter of the bore and a retard chamber port on the outer diameter of the rotor assembly; and a pattern of pockets surrounding each of the retard supply ports and the advance supply ports on the inner diameter of the bore, the pattern comprising a plurality of lands enclosing each of the retard supply ports and the advance supply ports on at least three sides, such that the retard supply ports and the advance supply ports are aligned on a same radial plane of the inner diameter of the bore of the rotor assembly relative to a center point of the bore of the rotor assembly and the lands form a continuous circumferential seal groove, sealing each of the retard supply ports and the advance supply ports from other retard supply ports and the advance supply ports.

2. The rotor assembly of claim 1, wherein a pocket of the pattern of pockets is formed by a first land on a first side, a second land on a second side, opposite the first side, and a third land connecting the first land and the second land along an outer perimeter of the bore.

3. The rotor assembly of claim 1, wherein the pattern of pockets extends around an entire circumference of the inner diameter of the bore of the rotor assembly.

4. The rotor assembly of claim 1, wherein the advance chamber port and the retard chamber port are aligned on the radial plane on an outer surface on the outer diameter between the vanes.

5. A variable cam timing phaser comprising:

a housing assembly having an outer circumference for accepting drive force;

a rotor assembly for connection to a camshaft received within the housing assembly, wherein the housing assembly and the rotor assembly define at least one chamber separated by a vane into advance chambers and retard chambers, the rotor assembly comprising:

an outer diameter with a plurality of vanes extending therefrom coaxially located within the housing assembly, and a bore having an inner diameter for receiving the camshaft comprising:

a plurality of passages comprising at least advance passages and retard passages, each of the advance and retard passages extending from the inner diameter of the bore to the outer diameter of the rotor assembly, such that the advance passages are in fluid communication with a fluid supply and an advance chamber and the retard passages are in fluid communication with the fluid supply and a retard chamber, the advance passages each having an advance supply port on the inner diameter of the bore and an advance chamber port on the outer diameter of the rotor assembly, the retard passages each having a retard supply port on the inner diameter of the bore and a retard chamber port on the outer diameter of the rotor assembly; and a pattern of pockets surrounding each of the retard supply ports and the advance supply ports on the inner diameter of the bore, the pattern comprising a plurality of lands enclosing each of the retard supply ports and the advance supply ports on at least three sides, such that the retard supply ports and the advance supply ports are aligned on a same radial plane of the inner diameter of the bore of the rotor assembly relative to a center point of the bore of the rotor assembly and the lands form a continuous circumferential seal groove, sealing each of the retard supply ports and the advance supply ports from other retard supply ports and the advance supply ports, wherein motion of the vane within the at least one chamber shifts a relative angular position of the housing assembly and the rotor assembly by fluid by a control valve.

6. The variable cam timing phaser of claim 5, wherein the pocket is formed by a first land on a first side, a second land on a second side, opposite the first side, and a third land connecting the first land and the second land along an outer perimeter of the bore.

7. The variable cam timing phaser of claim 5, wherein the pattern of pockets extends around an entire circumference of the inner diameter of the bore of the rotor assembly.

8. The variable cam timing phaser of claim 5, wherein the camshaft further comprises an advance camshaft passage with an advance inlet port in communication with the fluid supply and an advance outlet port in communication with the advance supply port on the inner diameter of the bore of the rotor assembly and a retard camshaft passage with a retard inlet port in communication with the fluid supply and a retard outlet port in communication with the retard supply port on the inner diameter of the rotor assembly.

9. A rotor assembly of a variable cam timing phaser comprising:

a single piece body comprising:

an outer diameter with vanes extending therefrom; and a bore having an inner diameter comprising a plurality of passages comprising at least advance passages and retard passages, each of the advance and retard passages extending from the inner diameter of the bore to the outer diameter of the rotor assembly, the advance passages each having an advance supply port on the inner diameter of the bore and an advance chamber port on the outer diameter of the rotor assembly, the retard passages each having a retard supply port on the inner diameter of the bore and a retard chamber port on the outer diameter of the rotor assembly; and a pattern of pockets surrounding each of the retard supply ports and the advance supply ports on the inner diameter of the bore, the pattern comprising a plurality of lands enclosing each of the retard supply ports and the advance supply ports on at least three sides, such that the retard supply ports and the advance supply ports are aligned on a same radial plane of the inner diameter of the bore of the rotor assembly relative to a center point of the bore of the rotor assembly and the lands form a continuous circumferential seal groove, sealing each of the retard supply ports and the advance supply ports from other retard supply ports and the advance supply ports.

* * * * *